US006148481A

United States Patent [19]

Chen

[11] Patent Number: 6,148,481

[45] Date of Patent: Nov. 21, 2000

[54] PIVOTAL DEVICE FOR DOOR AND WINDOW

[76] Inventor: Wen Hua Chen, No. 19, Lane 961, Wu Guang Road, Wu Jih Hsiang, Taichung Hsien, Taiwan

[21] Appl. No.: 09/357,961

[22] Filed: Jul. 21, 1999

[51] Int. Cl.[7] ..... E05D 11/10

[52] U.S. Cl. ..... 16/334; 16/344; 16/387

[58] Field of Search ..... 16/334, 329, 335, 16/308, 344, 387, 357, 361

[56] References Cited

U.S. PATENT DOCUMENTS

| | | | |
|---|---|---|---|
| 4,932,101 | 6/1990 | Lualdi | 16/255 |
| 5,235,726 | 8/1993 | Geier, Jr. et al. | 16/322 |
| 5,675,869 | 10/1997 | Lotz | 16/334 |
| 5,850,673 | 12/1998 | Wood, Sr. et al. | 16/334 |

FOREIGN PATENT DOCUMENTS

| | | | |
|---|---|---|---|
| 531216A | 3/1993 | European Pat. Off. | 16/334 |

*Primary Examiner*—Chuck Y. Mah
*Attorney, Agent, or Firm*—Bacon & Thomas, PLLC

[57] ABSTRACT

A pivotal device connected between a door and a door frame includes a first part connected to the door frame and a second part connected to the door. The first part has a torsion member connected thereto which has a roller connected to one of two ends of the torsion member. A cam member is rotatably mounted to the first part and has a plurality of recesses one of which is engaged with the roller. The second part has a tube which is rotatably mounted to a shaft of the first part and is fixedly connected to the cam member. The door is pivoted relative to the door frame and positioned at an angle when the roller is engaged with one of the recesses of the cam member.

7 Claims, 10 Drawing Sheets

PIVOTAL DEVICE FOR DOOR AND WINDOW

FIELD OF THE INVENTION

The present invention relates to a pivotal device connected between a door and a door frame and the pivotal device allows the door pivoted and positioned relative to the door frame at different angles.

BACKGROUND OF THE INVENTION

Conventional pivotal devices are simply connected between a door (window) and a door frame (window frame) so that the door can be maintained at a closed position relative to the door frame. Basically, the pivotal device employs a torsion spring to provide a return force to let the door (window) closes automatically after the door (window) is pivoted away from the frame. However, the door (window) can only be positioned at the closed position so that the door (window) cannot be positioned at 45 degrees or 90 degrees relative to the frame. If the users want to maintain the door (window) at the above mentioned angles, they have to hold the door (window) and cannot release it. This cannot meet requirements of the users because the users may expect the window to be opened and positioned at 45 degrees. Furthermore, the return force of the torsion force could make the door (window) return fast and the quick-return door (window) could hurt the users.

The present invention intends to provide a pivotal device for a door or a window and the pivotal device allows the door or window positioned at various angles relative to the frame. By the pivotal device of the present invention, the users need not to hold the door or the window to maintain it at the desired position.

SUMMARY OF THE INVENTION

In accordance with one aspect of the present invention, there is provided a pivotal device connected between a door and a door frame. The pivotal device comprises a first part connected to the door frame and the first part has a plate with a ring and a second ring connected to a surface of the plate. A support member extends from the plate and a shaft extends from the support member. A torsion member has a first hook end engaged with the first ring and a second hook end engaged with the second ring. A roller is connected to the second hook end. A cam member has a hole and a plurality of recesses defined in a periphery thereof with one of which the cam member is engaged, The cam member is mounted to the shaft. The second part has a plate and a tube is connected to the plate of the second part, wherein the first part is rotatably mounted to the shaft. The cam member is fixedly connected to the tube.

The primary object of the present invention is to provide a pivotal device connected between a door and a door frame, wherein the door can be positioned at a pre-desired angle relative to the door frame when the roller on the first part is engaged with one of the recesses of the second part.

These and further objects, features and advantages of the present invention will become more obvious from the following description when taken in connection with the accompanying drawings which show, for purposes of illustration only, several embodiments in accordance with the present invention.

DETAILED DESCRIPTION OF THE PREFERRED EMBODIMENTS

Figure 1:
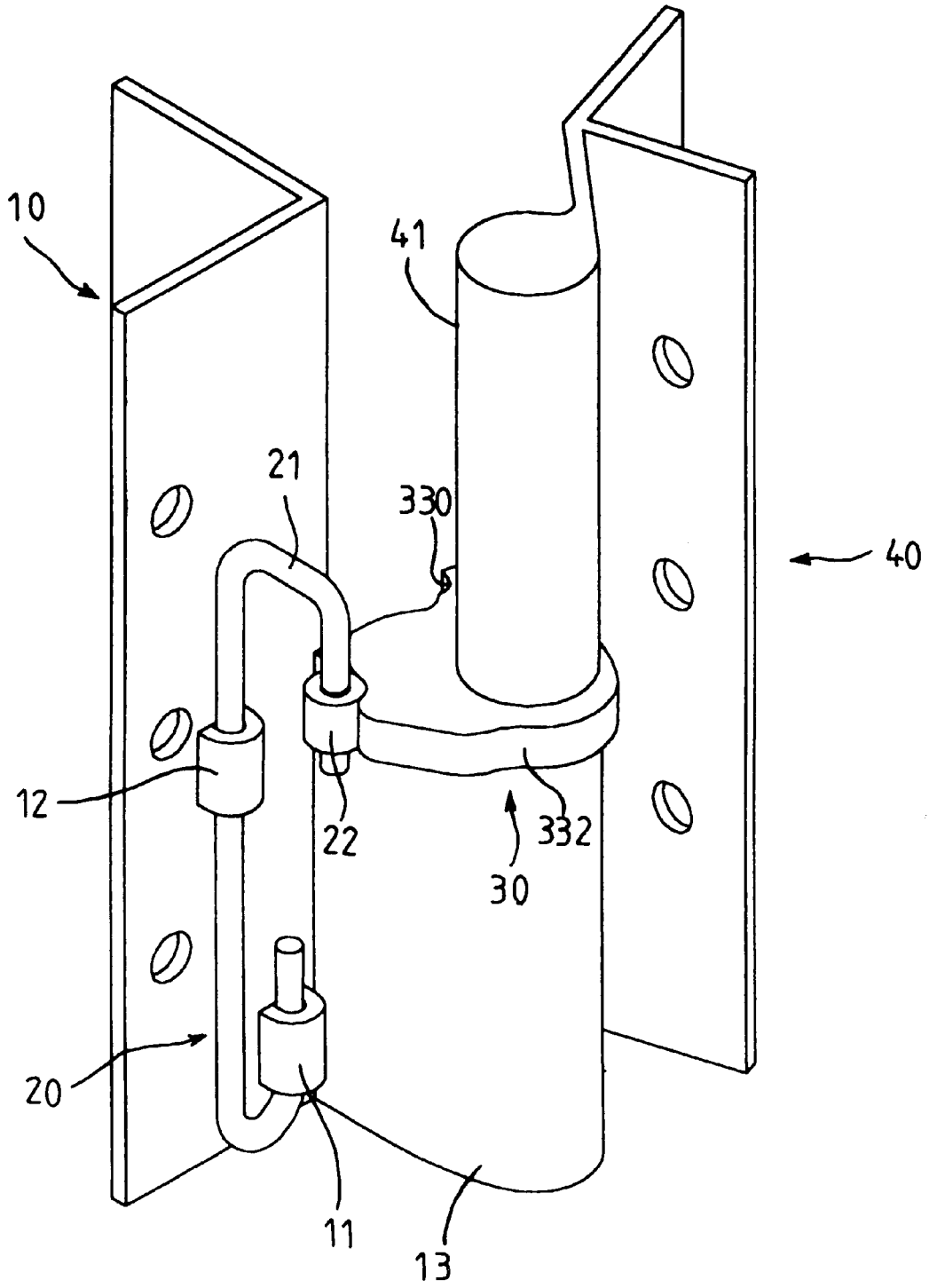
FIG. 1 is a perspective view of the pivotal device in accordance with the present invention.
Figure 2:
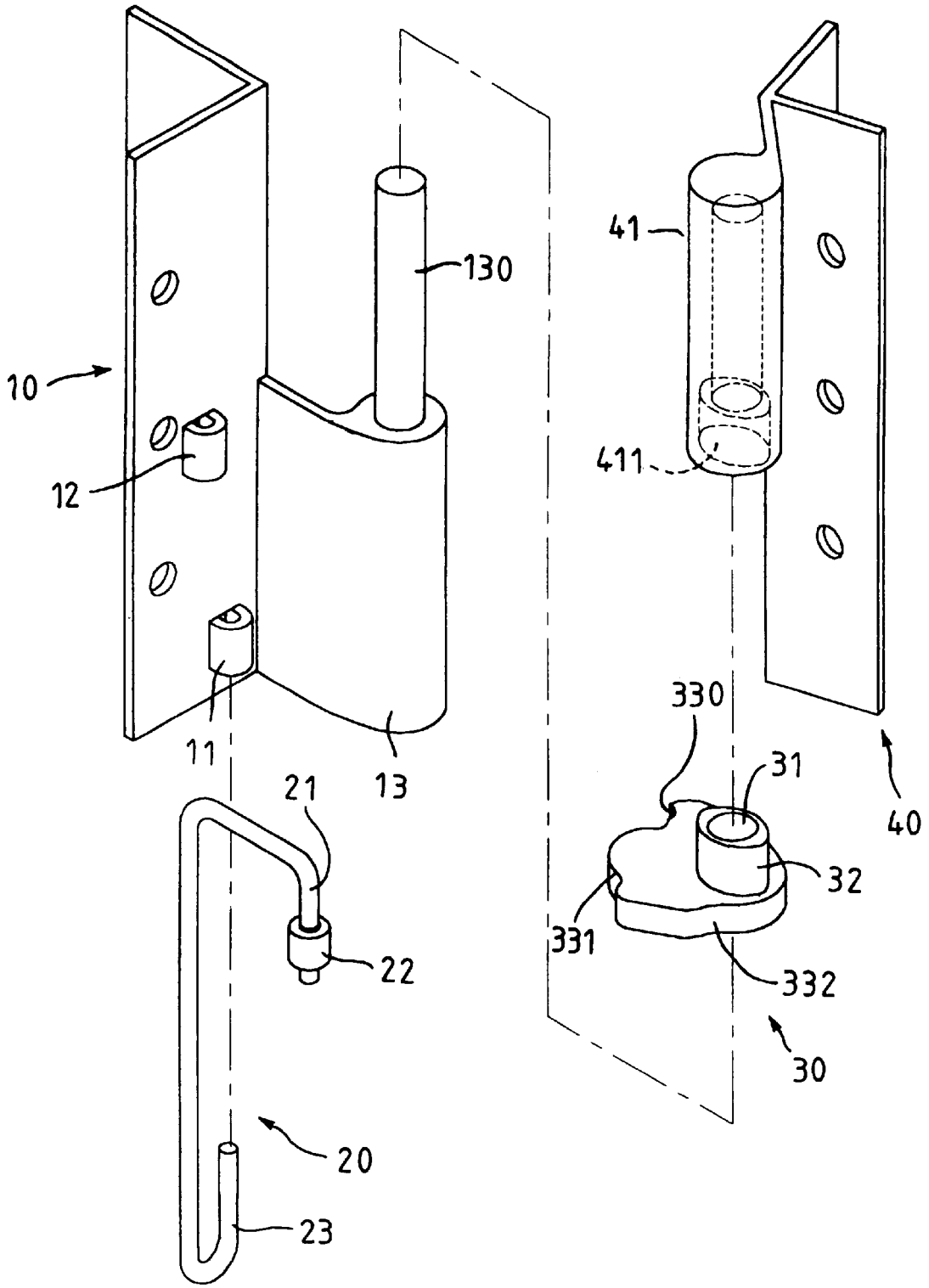
FIG. 2 is an exploded view of the pivotal device in accordance with the present invention.
Figure 3:
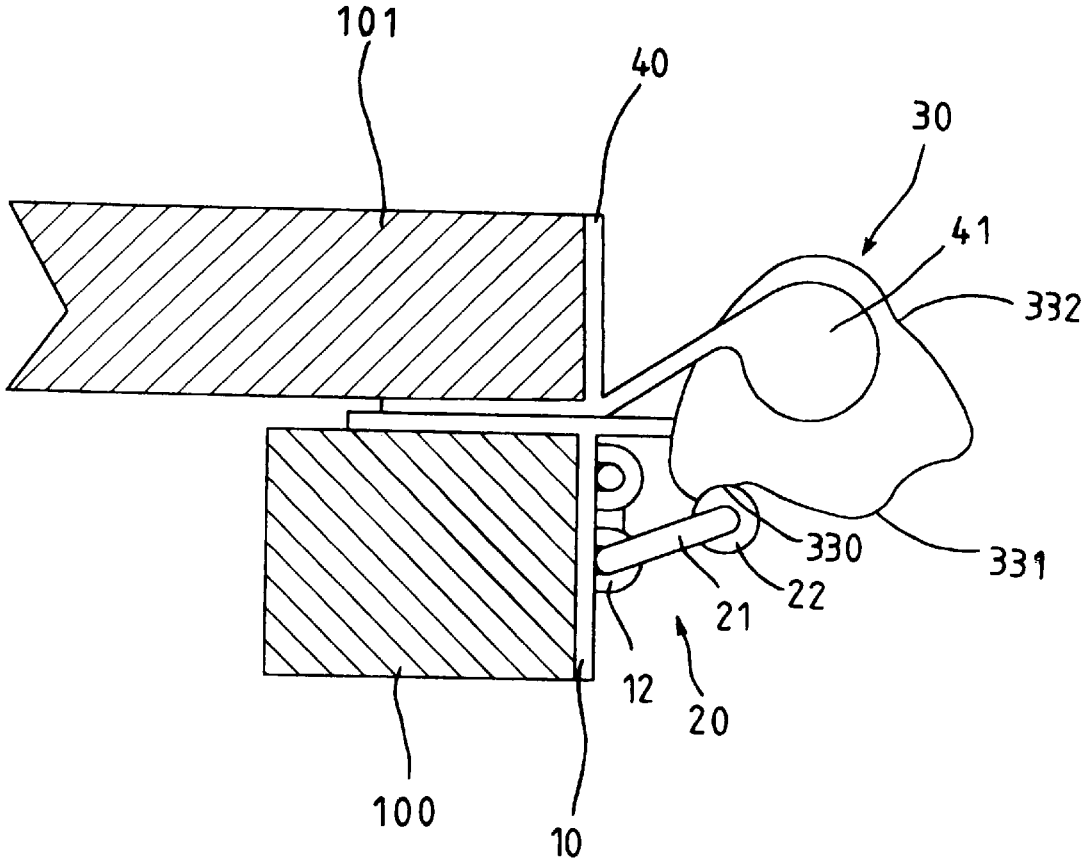
FIG. 3 is a top view, partly in section, of the pivotal device in accordance with the present invention, the door and the door frame, wherein the door is at the close position.
Figure 4:
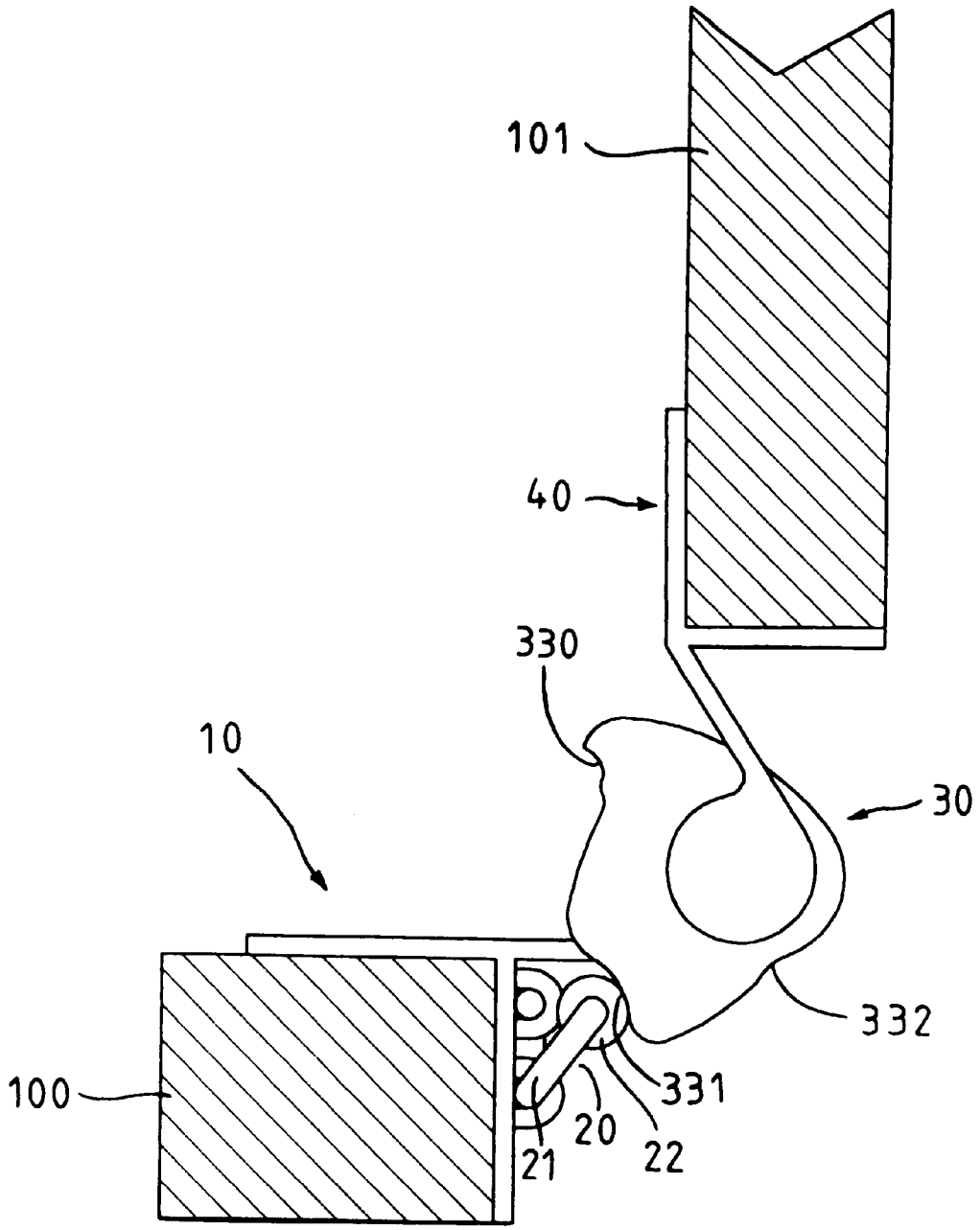
FIG. 4 is a top view, partly in section, of the pivotal device in accordance with the present invention wherein the door is opened at 90 degrees position.

Referring to FIGS. 1 to 3, the pivotal device of the present invention connected between a door 101 and a door frame 100 comprises a first part 10 connected to the door frame 100 and the first part 10 comprises a plate with a ring 11 and a second ring 12 connected to a surface of the plate. A support member 13 extends from the plate and a shaft 130 extends from the support member 13. A torsion member 20 has a first hook end 23 and a second hook end 21, the first hook end 23 is engaged with the first ring 12 and the second hook end 21 is engaged with the second ring 12. The first hook end 23 and the second hook end 21 extend in different directions. A roller 22 is connected to the second hook end 21.

A cam member 30 has a protrusion 32 extending form a surface thereof and a hole 31 is defined through the protrusion 32. The protrusion 32 is an oval tubular member.

A plurality of recesses 330, 331, 332 are defined in a periphery of the cam member 30. The roller 22 is engaged with one of the recesses 330, 331, 332 of the cam member 30. The cam member 30 is mounted to the shaft 130.

A second part 40 having a plate is connected to the door 101. A tube 41 is connected to the plate of the second part 40 and rotatably mounted to the shaft 130. The tube 41 has an oval tubular inside 411 so as to engage with the protrusion 32 so that the cam member 30 is moved together with the second part 40. The cam member 30 is therefore supported on the support member 13.

Figure 5:
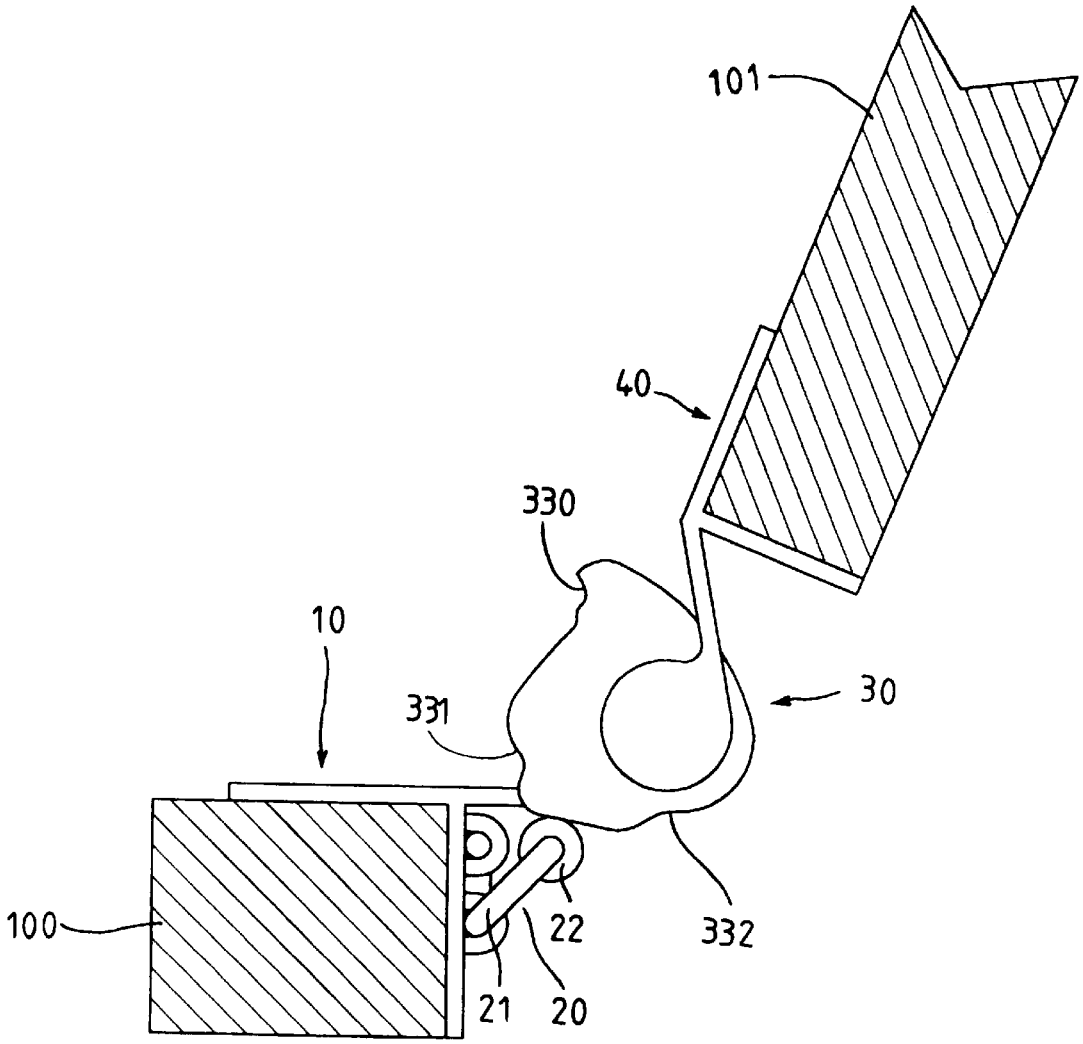
FIG. 5 is a top view, partly in section, of the pivotal device in accordance with the present invention wherein the door is opened at 135 degrees position.

When the door 101 is at the close position as shown in FIG. 3, the roller 22 is engaged with the recess 330. When the door 101 is opened to 90 degrees relative to the door frame 100, the cam member 30 is rotated with the door 101 and the roller 22 is moved and received in the recess 331. When the door 101 is pivoted to 135 degrees relative to the door frame 100 as shown in FIG. 5, the roller 22 then rolls along the cam member 30 and will be received in the recess 332. Therefore, whenever the roller 22 is engaged with one of the recesses 330, 331, 332, the door 101 can be positioned so that the user needs not to hold the door 101.

Figure 6:
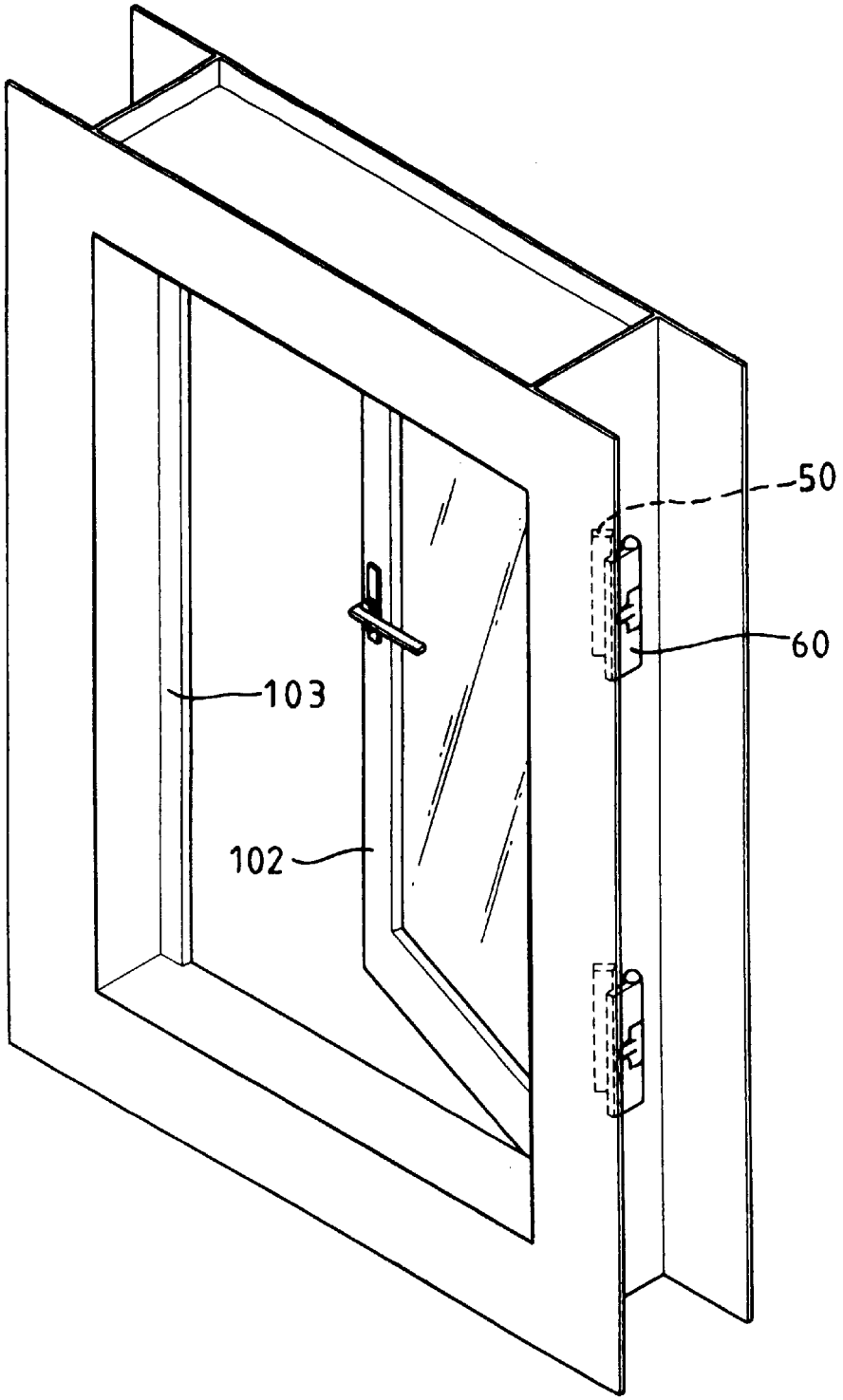
FIG. 6 is a perspective view to show the pivotal device is used on a window and a window frame.
Figure 7:
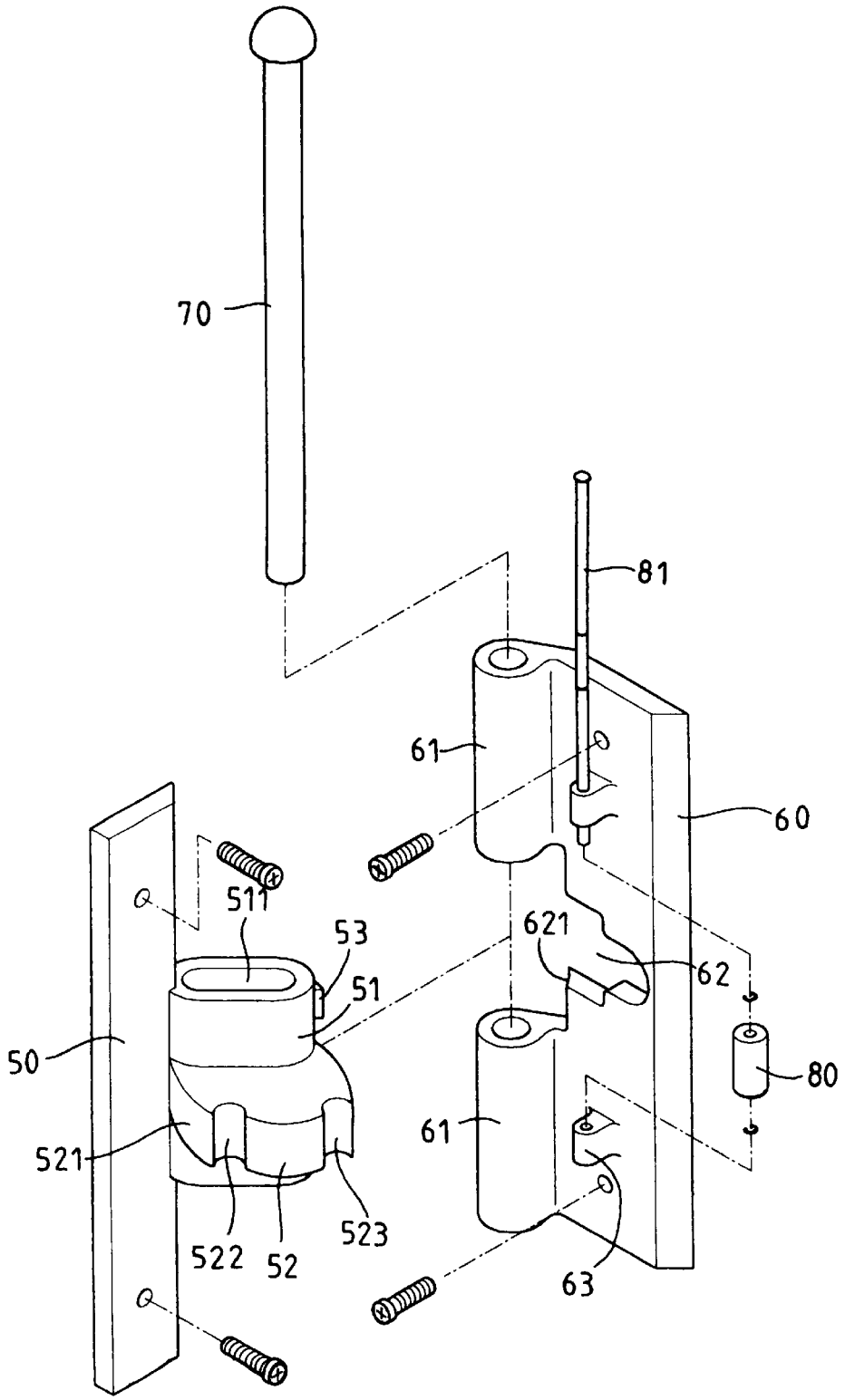
FIG. 7 is an exploded view of another embodiment of the pivotal device in accordance with the present invention used on the window and the window frame.
Figure 8:
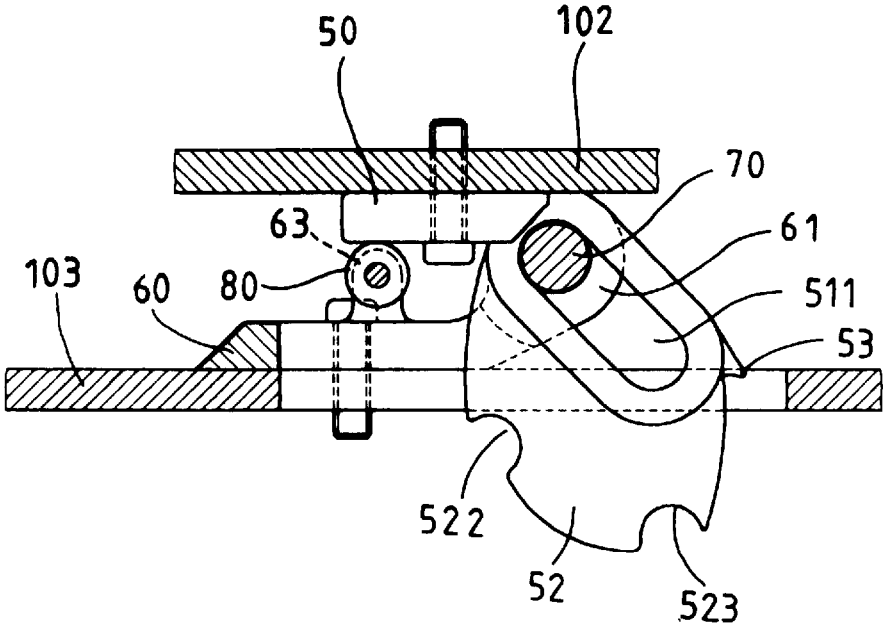
FIG. 8 is a top view, partly in section, of the pivotal device as shown in FIG. 7, wherein the window is at the close position.

Referring to FIGS. 6 to 8, the pivotal device can be used to the window 102 and the window frame 103. The pivotal device comprises a first part 60 connected to the window frame 103 and the first part 60 has a plate which has two lugs 61. A notch 62 is defined in a side of the plate and the notch 62 is located between the two lugs 61. The plate of the first part 60 has two rings 63 and a rod 81 extends through the two rings 63. The roller 80 is mounted to the rod 81.

The second part 50 has a plate and an elongated member 51 extends from the second part 50. The elongated member 51 has an elongated slot 511 defined therethrough. A cam member 52 extends laterally from the elongated member 51 and two recesses 522, 523 defined in a periphery of the cam member 52. The roller 80 is engaged with one of the recesses 522, 523 of the cam member 52 which is movably within the notch 62. A shaft 70 movably extends through the two lugs 61 and the elongated slot 511.

Figure 9:
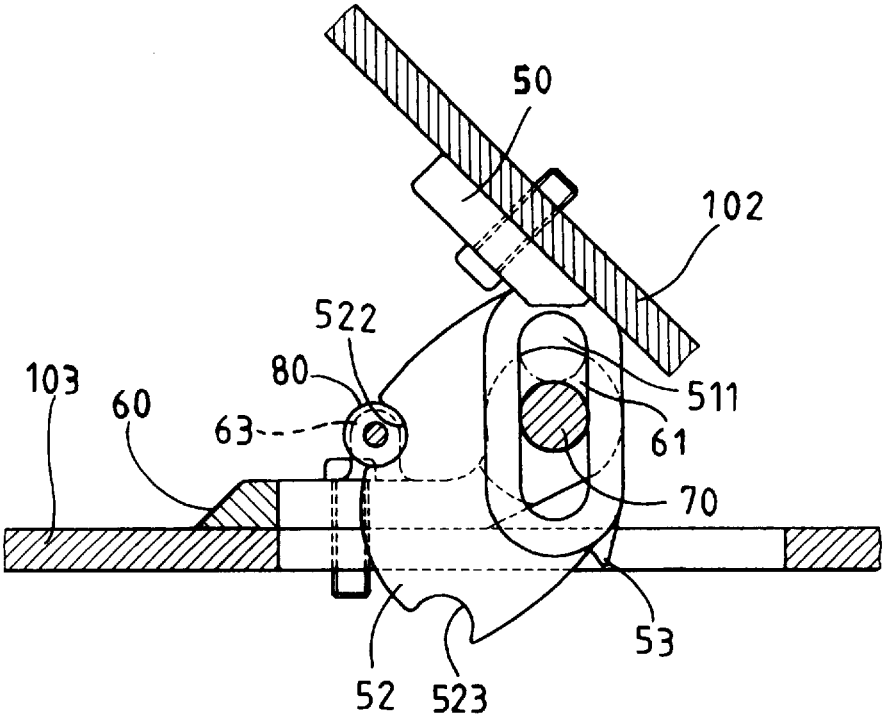
FIG. 9 is a top view, partly in section, of the pivotal device as shown in FIG. 7, wherein the window is opened at 45 degrees position.
Figure 10:
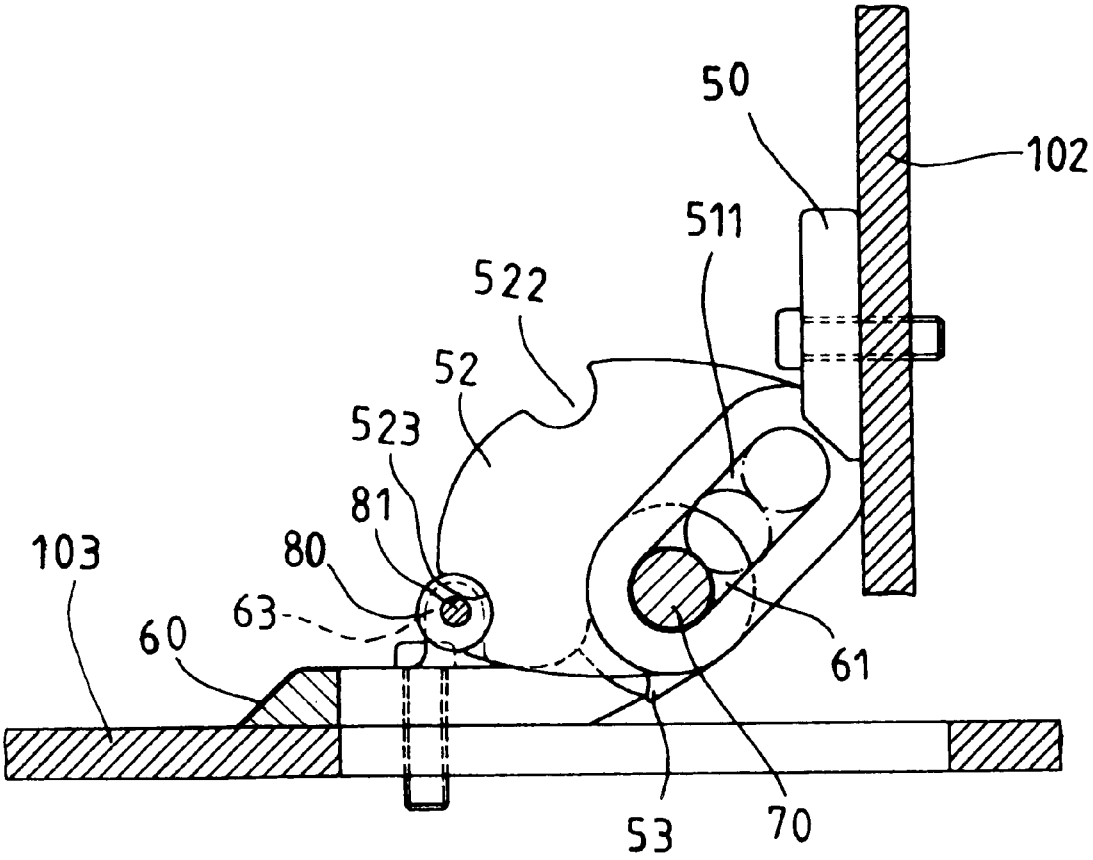
FIG. 10 is a top view, partly in section, of the pivotal device as shown in FIG. 7, wherein the window is opened at 90 degrees position.

FIG. 8 shows the window 102 is at close position where the roller 80 contacts the window 50. FIG. 9 shows that when the window 102 is opened 45 degrees, the roller 80 is engaged with the recess 522 and the window 102 is positioned, while the elongated member 51 is moved relative to the shaft 70. In FIG. 10, the window 102 is continued pivoted, the roller 80 is received in the recess 523 and positioned. A protrusion 53 extends laterally from the elongated member 51 and the protrusion 53 will contact the side 621 of the plate of the first part 60 to stop the second part 60.

Figure 11:
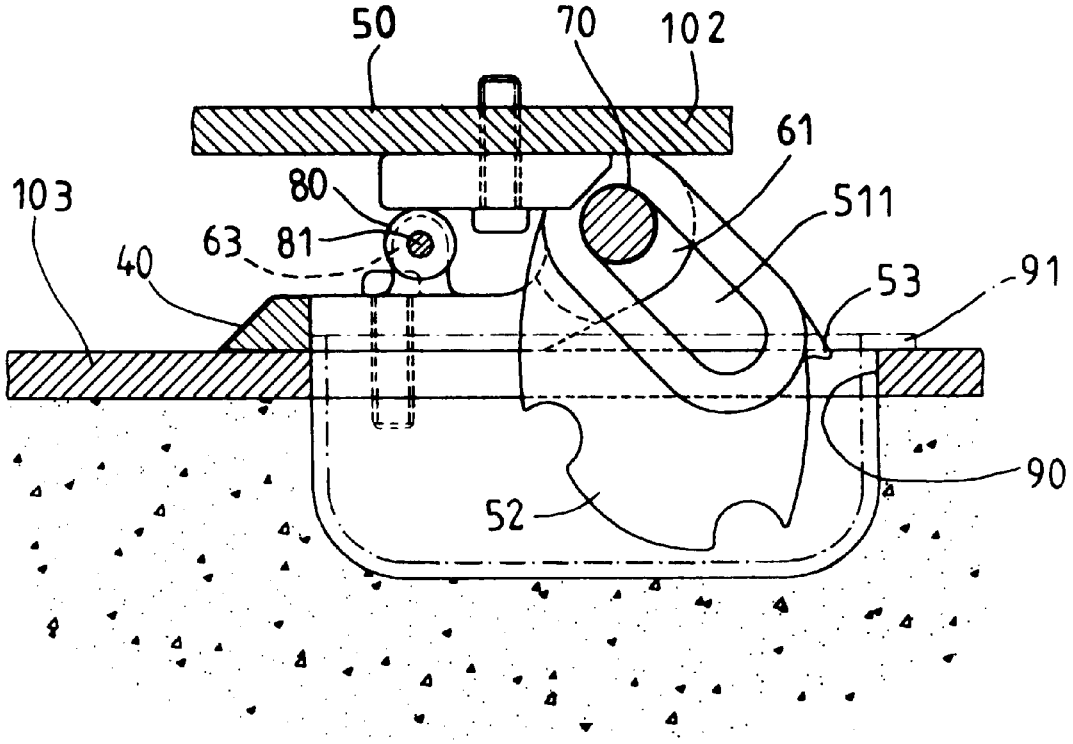
FIG. 11 is an illustrative view to show the device as shown in FIG. 7 is installed to a window frame in a wall.

FIG. 11 shows that the window frame 103 has a sink hole 90 for a box-like case 91 to be received therein so that the cam member 52 is received in the case 91 which is embedded in a wall.

While we have shown and described various embodiments in accordance with the present invention, it should be clear to those skilled in the art that further embodiments may be made without departing from the scope and spirit of the present invention.

What is claimed is:

1. A pivotal device connected between a door and a door frame, said pivotal device comprising:

a first part adapted to be connected to the door frame and comprising a plate with a ring and a second ring connected to a surface of said plate, a support member extending from said plate and a shaft extending from said support member;

a torsion member having a first hook end and a second hook end, said first hook end engaged with said first ring and said second hook end engaged with said second ring, a roller connected to said second hook end;

a cam member having a hole and a plurality of recesses defined in a periphery of said cam member, said roller engaged with one of said recesses of said cam member, said cam member mounted to said shaft, and a second part having a plate adapted to be connected to the door, a tube connected to said plate of said second part and rotatably mounted to said shaft, said cam member fixedly connected to said tube.

2. The pivotal device as claimed in claim 1, wherein said cam member has a protrusion extending form a surface thereof and said hole is defined through said protrusion, said protrusion being an oval tubular member and said tube having an oval tubular inside so as to engage with said protrusion.

3. The pivotal device as claimed in claim 1, wherein said cam member is supported on said support member.

4. A pivotal device connected between a window and a window frame, said pivotal device comprising:

a first part adapted to be connected to the window frame and comprising a plate which has two lugs, a roller connected to said plate;

a second part having a plate and an elongated member extending from said second part, said elongated member having an elongated slot defined therethrough, a cam member extending laterally from said elongated member and a plurality of recesses defined in a periphery of said cam member, said roller engaged with one of said recesses of said cam member, and a shaft movably extending through said two lugs and said elongated slot.

5. The pivotal device as claimed in claim 4 further comprising a notch defined in a side of said plate and said notch located between said two lugs so that said cam member movably located in said notch.

6. The pivotal device as claimed in claim 4 further comprising a protrusion extending laterally from said elongated member and said protrusion contacts said side of said plate of said first part to stop said second part.

7. The pivotal device as claimed in claim 4, wherein said plate of said first part has two rings and a rod extends through said two rings, said roller mounted to said rod.

* * * * *